US009109381B2

(12) United States Patent
Lee et al.

(10) Patent No.: US 9,109,381 B2
(45) Date of Patent: Aug. 18, 2015

(54) DOOR LATCH APPARATUS FOR VEHICLE

(71) Applicant: Hyundai Motor Company, Seoul (KR)

(72) Inventors: Sang Hyun Lee, Whasung-Si (KR); Ki Ryun Ahn, Whasung-Si (KR); Rae Ung Jeong, Whasung-Si (KR)

(73) Assignees: HYUNDAI MOTOR COMPANY, Seoul (KR); PYEONG HWA AUTOMOTIVE CO., LTD., Daegu (KR)

( * ) Notice: Subject to any disclaimer, the term of this patent is extended or adjusted under 35 U.S.C. 154(b) by 230 days.

(21) Appl. No.: 13/661,760

(22) Filed: Oct. 26, 2012

(65) Prior Publication Data

US 2013/0147211 A1 Jun. 13, 2013

(30) Foreign Application Priority Data

Dec. 13, 2011 (KR) ..... 10-2011-0133342

(51) Int. Cl.
*E05C 3/06* (2006.01)
*E05B 77/06* (2014.01)

(52) U.S. Cl.
CPC ..... *E05B 77/06* (2013.01)

(58) Field of Classification Search
USPC ..... 292/198, 195, DIG. 22
See application file for complete search history.

(56) References Cited

U.S. PATENT DOCUMENTS

| | | | | |
|---|---|---|---|---|
| 4,438,974 | A * | 3/1984 | Kresky et al. | 297/378.11 |
| 5,865,481 | A * | 2/1999 | Buschmann | 292/216 |
| 6,254,148 | B1 * | 7/2001 | Cetnar | 292/201 |
| 6,971,688 | B2 * | 12/2005 | Drysdale et al. | 292/216 |
| 7,607,702 | B2 * | 10/2009 | Pereverzev | 292/216 |
| 8,303,004 | B2 * | 11/2012 | Lee et al. | 292/216 |
| 8,322,077 | B2 * | 12/2012 | Papanikolaou et al. | 49/460 |
| 8,387,311 | B2 * | 3/2013 | Heller | 49/503 |

FOREIGN PATENT DOCUMENTS

| | | |
|---|---|---|
| KR | 10-2010-00026 26 A | 1/2010 |
| KR | 10-2011-0019672 A | 2/2011 |

* cited by examiner

*Primary Examiner* — Mark Williams
(74) *Attorney, Agent, or Firm* — Morgan, Lewis & Bockius LLP

(57) ABSTRACT

A door latch apparatus for a vehicle may include an open lever and a release lever rotatably coupled to a base plate, an interlocking lever rotatably coupled to the base plate and having a pushing protrusion, an operating lever provided on the base plate wherein the operating lever includes a second slot formed in a medial portion of the operating lever, and a locking protrusion formed on a lower end of the operating lever and being engaged in a first slot of the release lever, wherein when the release lever rotates, the locking protrusion pushes and rotates the open lever, thus releasing the door, and an inertia lever rotatably coupled to the base plate by a rotating shaft and including an insert protrusion formed on an end of the inertia lever and being engaged to the second slot.

9 Claims, 8 Drawing Sheets

DOOR LATCH APPARATUS FOR VEHICLE

CROSS-REFERENCE TO RELATED APPLICATION

The present application claims priority to Korean Patent Application No. 10-2011-0133342, filed on Dec. 13, 2011, the entire contents of which is incorporated herein for all purposes by this reference.

BACKGROUND OF THE INVENTION

1. Field of the Invention

The present invention relates to a door latch apparatus for a vehicle which is configured such that a door is prevented from opening while a side collision is occurring, and the door is allowed to open after the side collision is over.

2. Description of Related Art

FIG. 1 is a view showing a conventional door latch apparatus for a vehicle. FIG. 2 is a view showing the operation of the door latch apparatus of FIG. 1. FIG. 3 is a side view of the door latch apparatus of FIG. 1.

As shown in the drawings, the conventional door latch apparatus includes a release lever 20 which is rotatably provided on a base plate 10. On the release lever there is provided a locking part 24 that extends a predetermined length downwards, and a rotating lever 30 is rotatably installed on the base plate 10 at a position adjacent to the locking part 24. A wire is connected to a lower end 31 of the rotating lever 30 so that when a passenger operates a door handle, the wire is pulled, rotating the rotating lever 30 in the clockwise direction.

Furthermore, a locking protrusion 32 is provided on an upper end of the rotating lever 30. Thus, when the wire is pulled, the rotating lever 30 rotates around a rotating shaft 33 in the clockwise direction, and the locking protrusion 32 pushes the locking part 24 of the release lever 20 in the counterclockwise direction. Thereby, the release lever 20 rotates in the counterclockwise direction, thus also rotating an open lever 40 in the counterclockwise direction. Eventually, the open lever 40 that rotates in the counterclockwise direction unlocks the lock of the door.

The release lever 20 is provided with a restoring spring 22 so that when the pulling force which has been transmitted to the release lever 20 from the door handle through the wire is removed, the release lever 20 can return to its original position.

FIG. 1 illustrates the locked state of the conventional door latch apparatus. FIG. 2 illustrates the unlocked state of the door latch apparatus. FIG. 3 is a side view of the door latch apparatus, from which the base plate has been skipped for the sake of understanding.

In this conventional door latch apparatus having the above-mentioned construction, when the vehicle is involved in a side collision, for example, when impact is applied to the door from the left based on FIGS. 1 and 2, if a passenger manipulates the door handle, the wire is directly pulled, thus unexpectedly opening the door.

In other words, the conventional door latch apparatus allows latching and releasing of the door even when a side collision is occurring. This means that there is a probability that the door will open while the collision is occurring, deteriorating safety.

To take safety into account, in the side collision, the door must not open when the collision is ongoing, but after the collision is over, the door must be able to open to allow a passenger to escape from the vehicle. A door latch apparatus which incorporates such safety in a collision is required.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a door latch apparatus for a vehicle which is configured such that a door is prevented from opening when a side collision is occurring, and the door is allowed to open after the side collision is over.

In an aspect of the present invention, a door latch apparatus for a vehicle, may include an open lever rotatably coupled to a base plate by a first hinge pin to lock/release a door depending on rotation thereof, a release lever rotatably coupled to the base plate by the first hinge pin along with the open lever and having a first slot extending in a predetermined length, an interlocking lever rotatably coupled to the base plate by a hinge shaft and having a pushing protrusion provided on an end of the interlocking lever, the pushing protrusion coming into contact with a lower end of the release lever so that the release lever is rotated by rotation of the interlocking lever, an operating lever provided on the base plate so as to be rotatable and vertically movable, the operating lever including a second slot formed in a medial portion of the operating lever, and a locking protrusion formed on a lower end of the operating lever and being engaged in the first slot, wherein when the release lever rotates, the locking protrusion pushes and rotates the open lever, thus releasing the door, and an inertia lever rotatably coupled to the base plate by a rotating shaft and including an insert protrusion formed on an end of the inertia lever and being engaged to the second slot, wherein when the vehicle is involved in a side collision, the inertia lever is reversely rotated by a force of inertia so that the insert protrusion moves the operating lever downwards, thus displacing the operating lever from a position at which the locking protrusion of the operating lever pushes the open lever.

A wire of a door handle is connected to a first end of the interlocking lever.

The release lever may include an extension part extending downwards, the first slot is longitudinally formed in the extension part, the lower end of the open lever along with the first slot comes into contact with the locking protrusion, and the lower end of the open lever is shorter than the first slot.

The release lever and the open lever are elastically pivotable about the first hinge pin so that the release lever and the open lever return to original positions thereof after having rotated.

A pivot protrusion is provided on an end of the operating lever, and an auxiliary bracket is provided on the base plate, the auxiliary bracket having a third slot in which the pivot protrusion is engaged, wherein the pivot protrusion of the operating lever vertically moves and rotates along the third slot.

The auxiliary bracket is elastically and rotatably coupled to the base plate so that when the inertial force is removed after the operating lever may have been rotated by the reverse rotation of the inertia lever, the auxiliary bracket returns to an original position thereof, thus moving the operating lever upwards.

The pivot protrusion is provided on an upper end of the operating lever, the second slot is formed in the medial portion of the operating lever, and the locking protrusion is provided on the lower end of the operating lever.

A medial portion of the inertia lever is coupled to the base plate by the rotating shaft, the insert protrusion is provided on a first end of the inertia lever, and a balance weight is provided on a second end of the inertia lever.

A first end and a second end of the inertia lever are bent from each other based on a medial portion of the inertia lever, wherein the medial portion of the inertia lever is coupled to the base plate by the rotating shaft, the insert protrusion is provided on the first end of the inertia lever, and a balance weight is provided on the second end of the inertia lever.

A door latch apparatus for a vehicle according to the present invention makes use of a weight structure such that in a side collision of the vehicle, even when a door handle is operated by a passenger or other objects in the compartment of the vehicle, the door cannot open while the collision is occurring. On the other hand, after the collision is over, it again becomes possible for the passenger to open the door using the door handle.

Therefore, while the collision is ongoing, the door is prevented from opening, and after the collision is over, the door is allowed to open. As a result, safety in the collision can be ensured.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
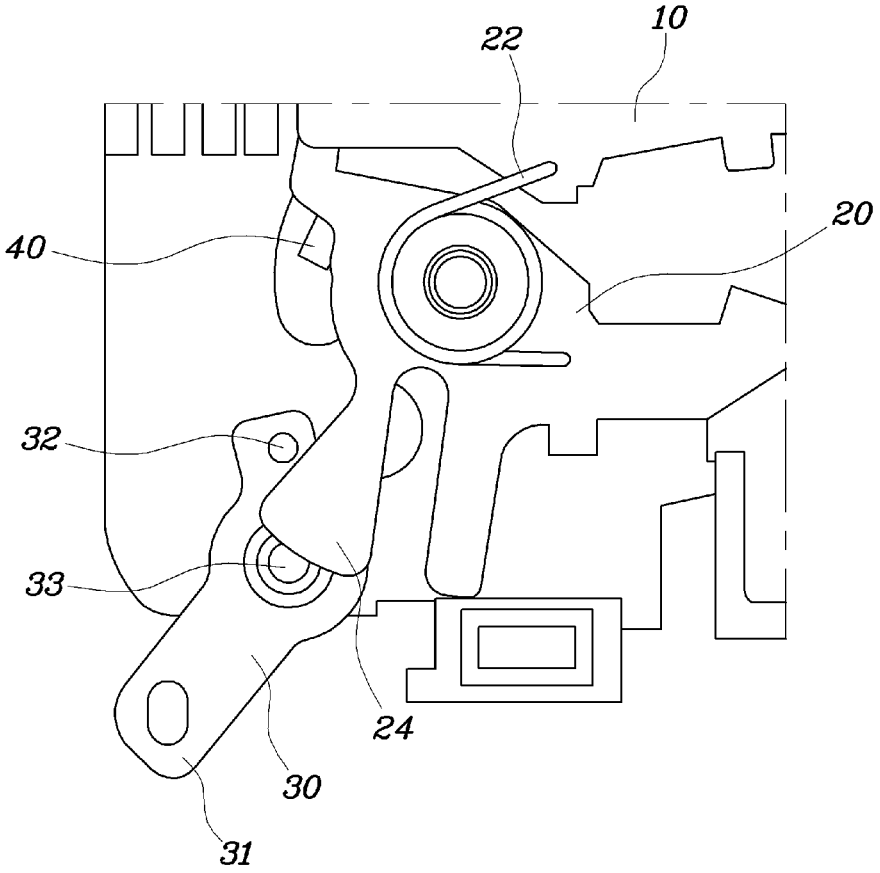
Fig. 1 (Related Art)
FIG. 1 is a view showing a conventional door latch apparatus for a vehicle.
Figure 2:
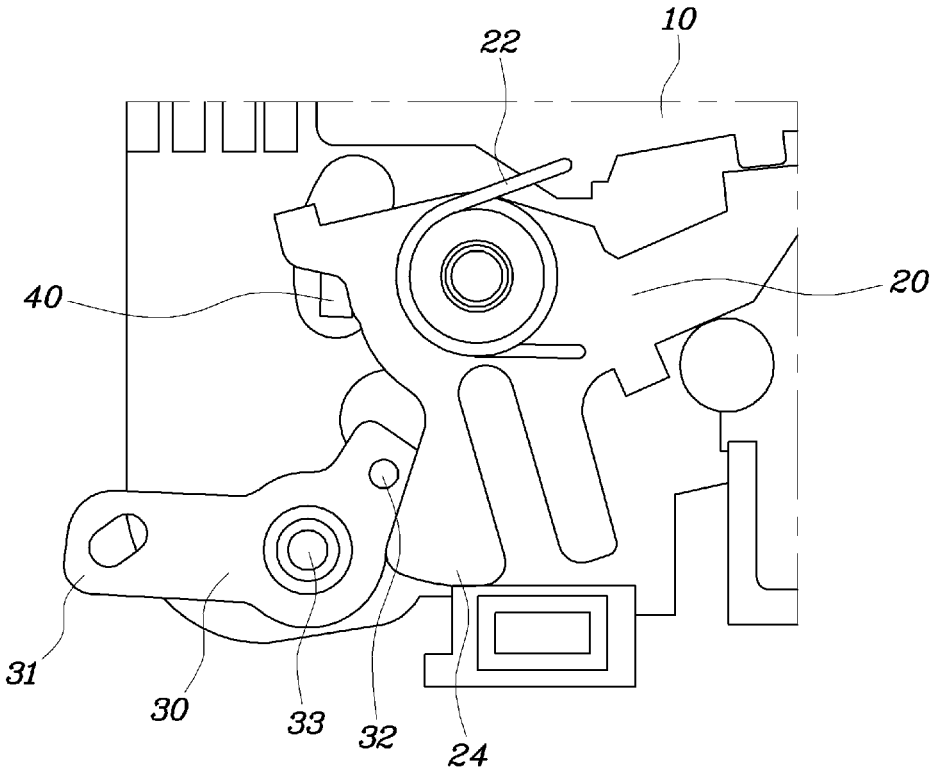
Fig. 2 (Related Art)
FIG. 2 is a view showing the operation of the door latch apparatus of FIG. 1.
Figure 3:
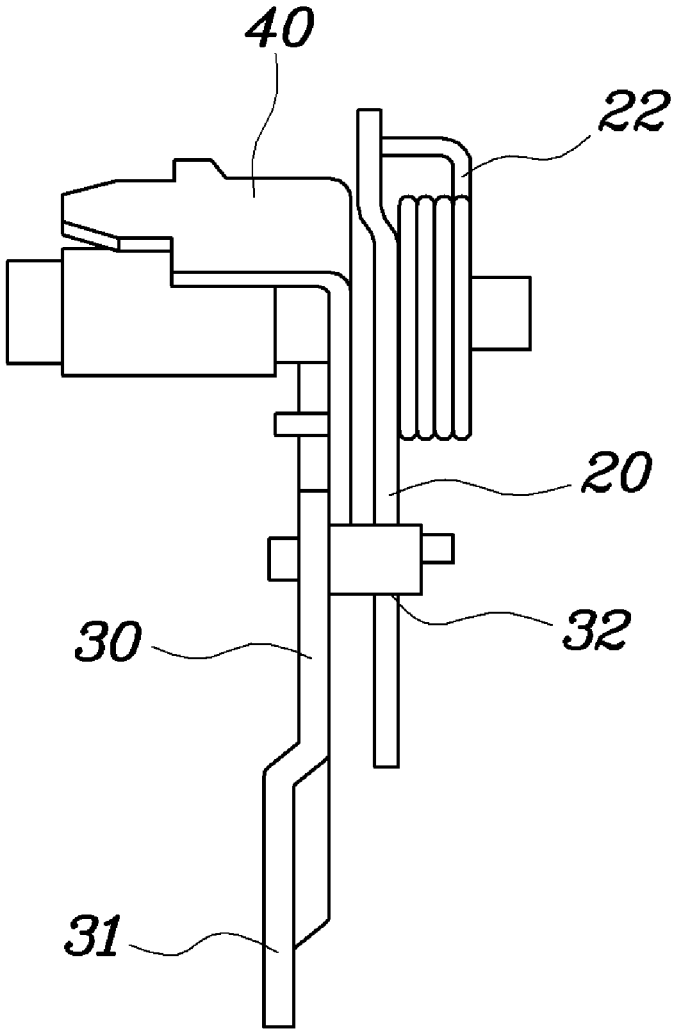
Fig. 3 (Related Art)
FIG. 3 is a side view of the door latch apparatus of FIG. 1.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, a door latch apparatus according to an exemplary embodiment of the present invention will be described in detail with reference to the attached drawings.

Figure 4:
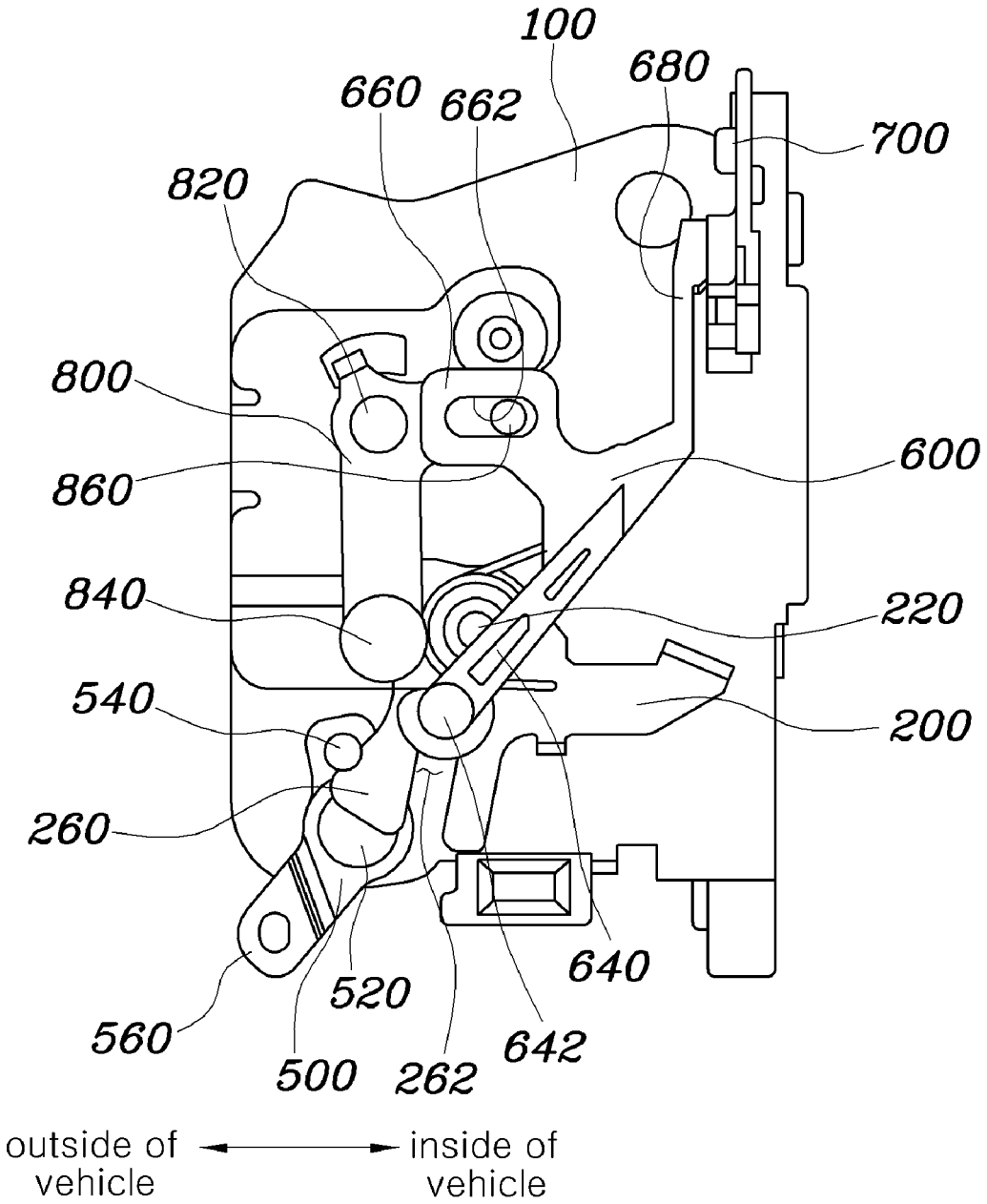
FIG. 4 is a view illustrating a first state of a door latch apparatus for a vehicle according to an exemplary embodiment of the present invention.
Figure 5:
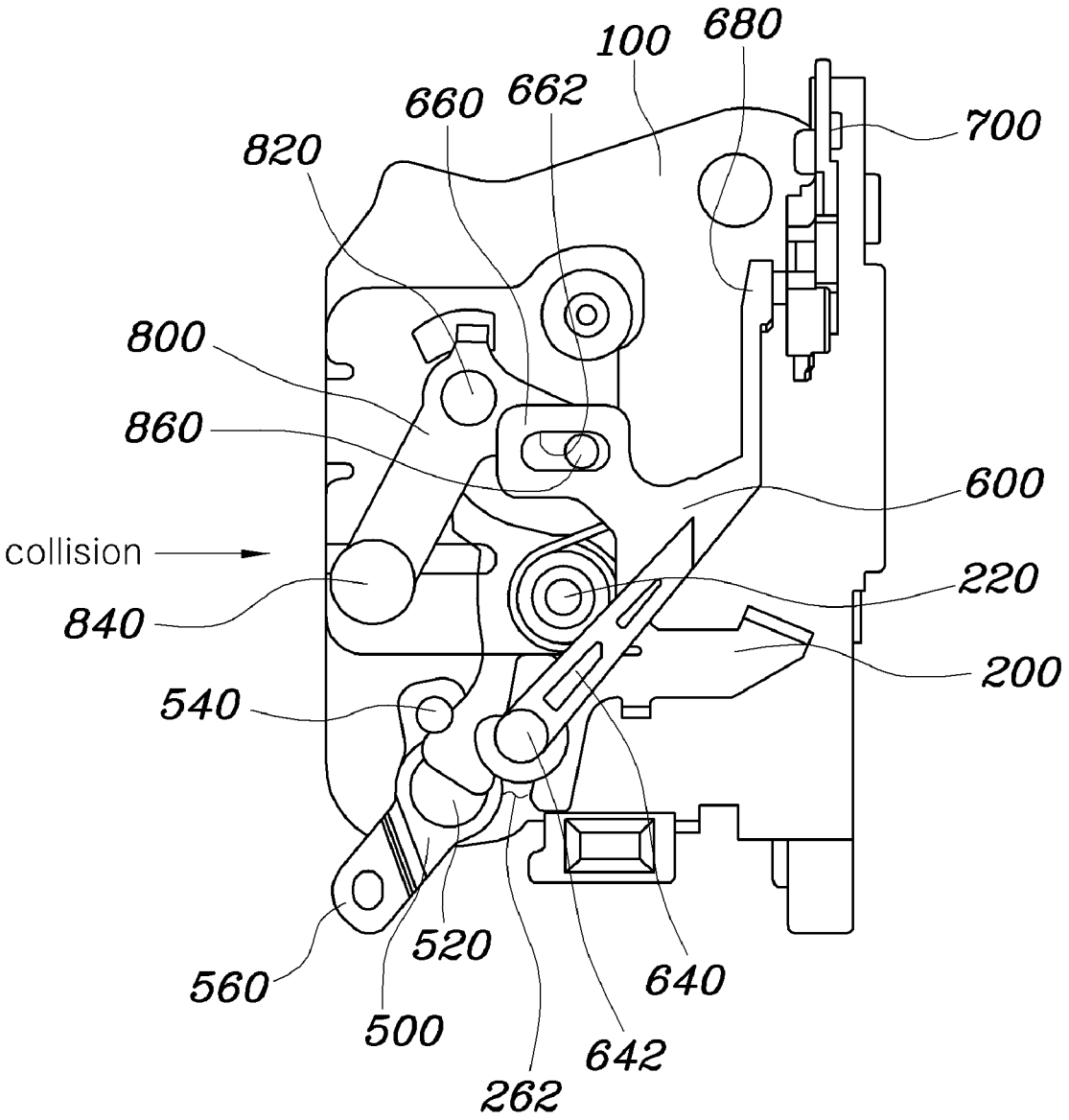
FIG. 5 is a view illustrating a second state of the door latch apparatus according to the exemplary embodiment of the present invention.
Figure 6:
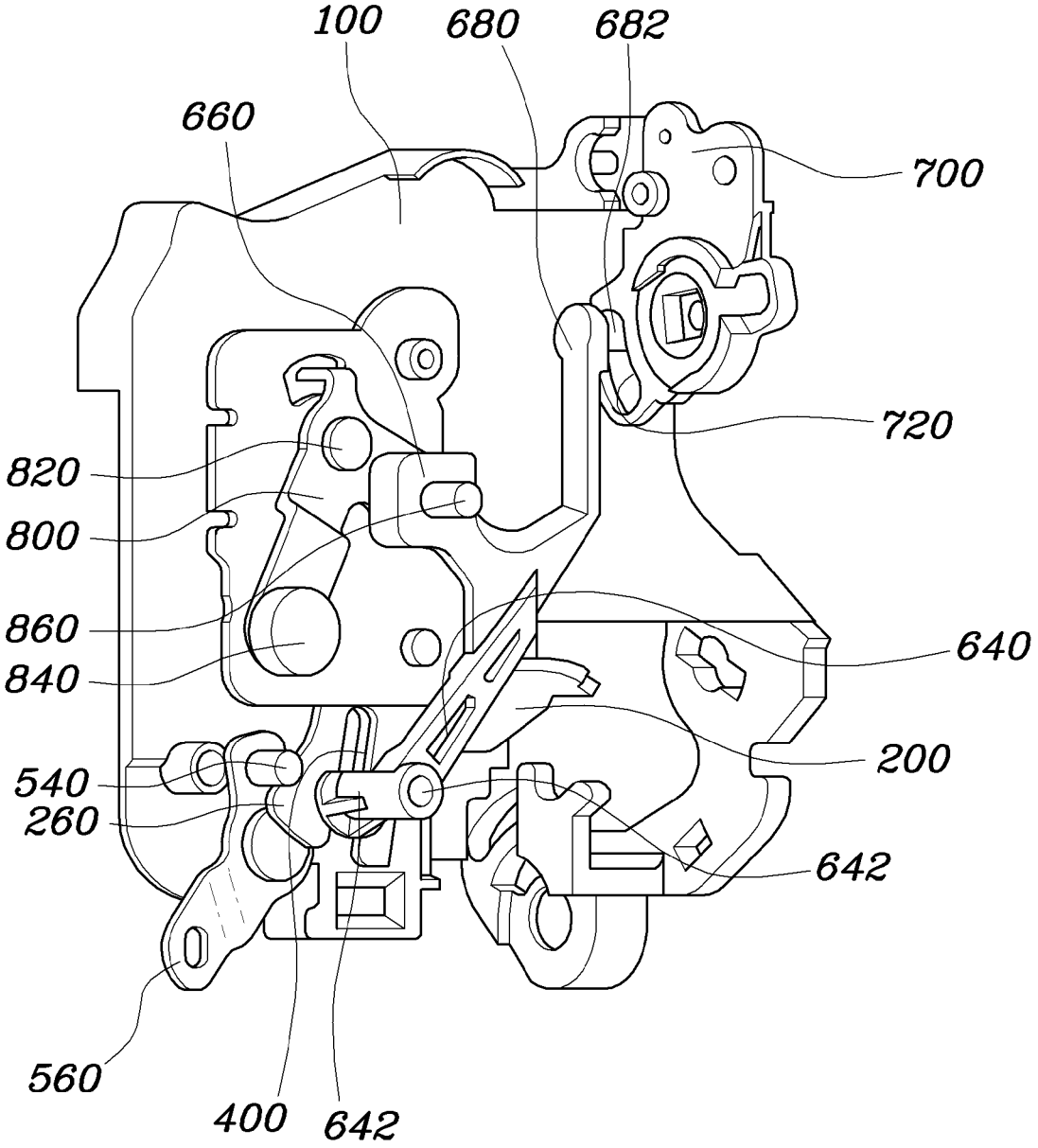
FIG. 6 is a perspective view showing the door latch apparatus of FIG. 5 from a different angle.
Figure 7:
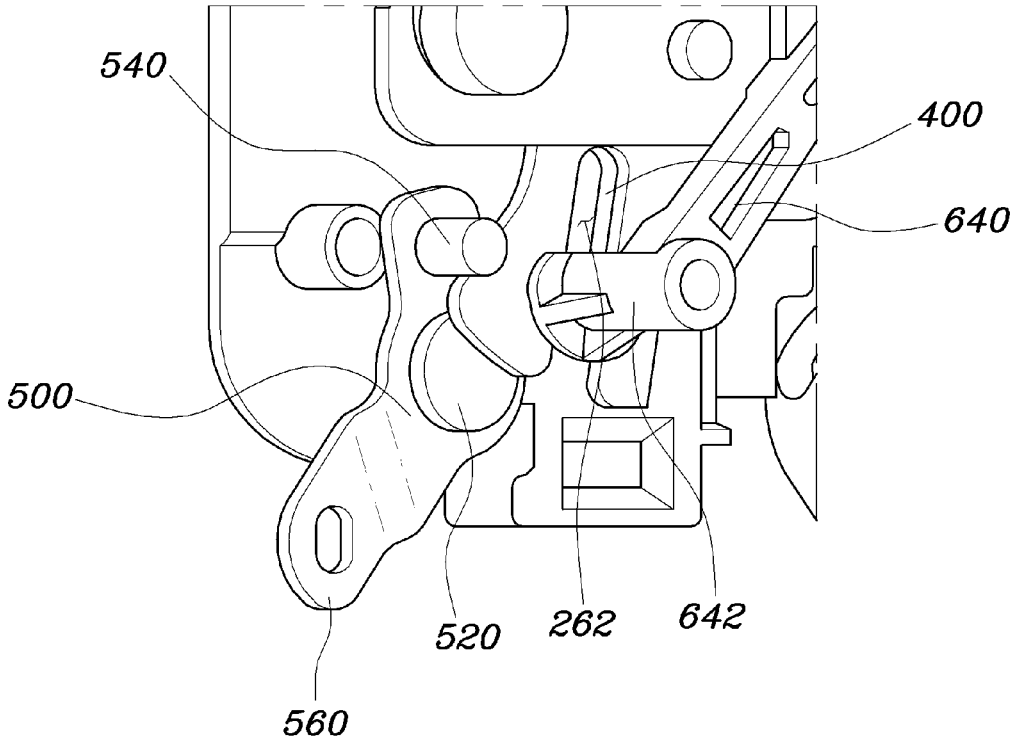
FIG. 7 is a perspective view showing a critical portion of the door latch apparatus of FIG. 6.
Figure 8:
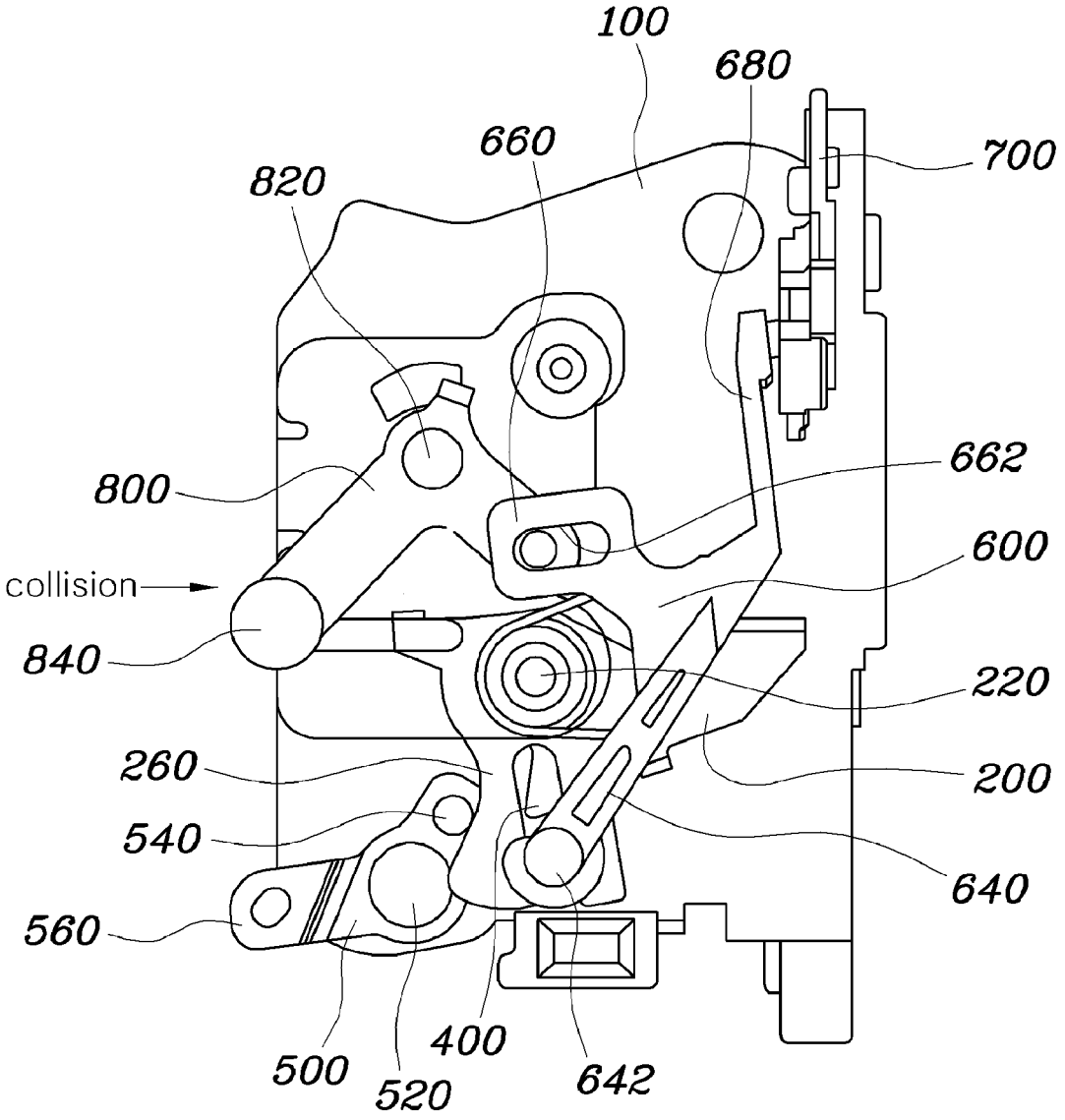
FIG. 8 is a view illustrating a third state of the door latch apparatus according to the exemplary embodiment of the present invention.

FIG. 4 is a view illustrating a first state of a door latch apparatus for a vehicle according to an exemplary embodiment of the present invention. FIG. 5 is a view illustrating a second state of the door latch apparatus according to the exemplary embodiment of the present invention. FIG. 6 is a perspective view showing the door latch apparatus of FIG. 5 from a different angle. FIG. 7 is a perspective view showing a critical portion of the door latch apparatus of FIG. 6. FIG. 8 is a view illustrating a third state of the door latch apparatus according to the exemplary embodiment of the present invention.

The door latch apparatus according to an exemplary embodiment of the present invention includes an open lever 400, a release lever 200, an interlocking lever 500, an operating lever 600 and an inertia lever 800. The open lever 400 is mounted to a base plate 100 by a hinge pin 220 and rotated to lock or unlock a vehicle door. The release lever 200 is provided around the hinge pin 220 along with the open lever 400. A first slot 262 is formed in the release lever 200 and extends vertically downwards. The interlocking lever 500 is mounted to the base plate 100 by a hinge shaft 520. A wire of a door handle is connected to a first end 560 of the interlocking lever 500. A pushing protrusion 540 is provided on a second end of the interlocking lever 500. The pushing protrusion 540 comes into contact with a lower end 260 of the release lever 200. Thus, when the wire is pulled, the interlocking lever 500 rotates so that the pushing protrusion 540 pushes the lower end 260 of the release lever 200, thus rotating the release lever 200. The operating lever 600 is provided on the base plate 100 so as to be rotatable and vertically movable. A locking protrusion 642 is provided on a lower end 640 of the operating lever 600 and disposed in the first slot 262 so that when the release lever 200 rotates, the locking protrusion 642 pushes the open lever 400 and rotates it, releasing the door. A second slot 662 is formed in a medial portion 660 of the operating lever 600. The inertia lever 800 is provided on the base plate 100 by a rotating shaft 820. An insert protrusion 860 is provided on an end of the inertia lever 800 and disposed in the second slot 662. When the vehicle is involved in a side collision, the inertia lever 800 is reversely rotated by the inertia so that the insert protrusion 860 moves the operating lever 600 downwards, thus displacing the operating lever 600 from a position at which the locking protrusion 642 of the operating lever 600 can push the open lever 400.

In detail, as shown in FIG. 4, in the door latch apparatus according to an exemplary embodiment of the present invention, the interlocking lever 500 is coupled to the base plate 100 by the hinge shaft 520, the wire of the door handle is connected to the first end 560 of the interlocking lever 500, and the pushing protrusion 540 that comes into contact with the lower end 260 of the release lever 200 is provided on the second end of the interlocking lever 500. Therefore, the interlocking lever 500 is operated in such a way that when the wire is pulled, the interlocking lever 500 rotates and the pushing protrusion 540 pushes the lower end 260 of the release lever 200, thus rotating the release lever 200.

The door handle is provided in the passenger compartment of the vehicle. The door handle is connected to the interlocking lever 500 by the wire. To release the door, the operation of the door handle pulls the wire, thus rotating the interlocking lever 500 in the clockwise direction.

When the interlocking lever 500 rotates in the clockwise direction, the pushing protrusion 540 of the interlocking lever 500 pushes the lower end 260 of the release lever 200, thus rotating the release lever 200 in the counterclockwise direction. Then, the open lever 400 that is disposed behind the release lever 200 is also pushed by the locking protrusion 642 and rotated in the counterclockwise direction, thus releasing the door.

The open lever 400, along with the release lever 200, is provided on the base plate 100 by the hinge pin 220. The open lever 400 functions to lock or release the door depending on the rotation. The open lever 400 is well known in this art, therefore a further detailed explanation will be omitted. The location of the open lever 400 is shown in FIGS. 7 and 8.

The operating lever 600 is provided on the base plate 100 so as to be rotatable and vertically movable. When the release lever 200 rotates in the counterclockwise direction, the operating lever 600 rotates along with the release lever 200 at a predetermined angle in the counterclockwise direction, because the locking protrusion 642 is disposed in the first slot 262 of the release lever 200.

For this, a pivot protrusion 682 is provided on the operating lever 600. The pivot protrusion 682 is disposed in a slot of the base plate 100 so as to be vertically movable and, in addition, can rotate in the slot at a predetermined angle because the pivot protrusion 682 is disposed in the slot with an appropriate clearance.

FIG. 5 is a view illustrating the second state of the door latch apparatus according to the exemplary embodiment of the present invention. FIG. 5 shows when inertia acts on the inertia lever just after a side collision has occurred. As shown in the drawing, in a side collision of the vehicle, inertial force is applied to the inertia lever 800 in the direction of the collision. Thus, the inertia lever 800 reversely rotates in the direction of the collision, in other words, in the clockwise direction.

The release lever 200 is provided on the hinge pin 220 along with the open lever 400. The first slot 262 which vertically extends downwards is formed in the release lever 200. The interlocking lever 500 is mounted to the base plate 100 by the hinge shaft 520. The wire of the door handle is connected to the first end 560 of the interlocking lever 500. The pushing protrusion 540 which comes into contact with the lower end 260 of the release lever 200 is provided on the second end of the interlocking lever 500. Pulling the wire rotates the interlocking lever 500 so that the pushing protrusion 540 pushes the lower end 260 of the release lever 200, thus rotating the release lever 200.

The operating lever 600 is coupled to the base plate 100 so as to be rotatable and vertically movable. The locking protrusion 642 is provided on the lower end 640 of the operating lever 600 and disposed in the first slot 262 so that when the release lever 200 rotates, the locking protrusion 642 pushes the open lever 400 and rotates it, thus releasing the door. The second slot 662 is formed in the medial portion 660 of the operating lever 600.

The inertia lever 800 is coupled to the base plate 100 by the rotating shaft 820. The insert protrusion 860 is provided on the end of the inertia lever 800 and disposed in the second slot 662. Thus, in a side collision of the vehicle, the inertia lever 800 is reversely rotated by the inertia so that the insert protrusion 860 moves the operating lever 600 downwards. Then, the locking protrusion 642 of the operating lever 600 is displaced from the position at which it can push the open lever 400.

Therefore, when the inertia lever 800 is reversely rotated in the clockwise direction by inertia derived from a side collision, the insert protrusion 860 of the inertia lever 800 pushes the operating lever 600 and moves it downwards. Thereby, the locking protrusion 642 of the operating lever 600 is moved downwards and thus displaced from the position at which it can push the open lever 400.

In an exemplary embodiment of the present invention having the above-mentioned construction, while a side collision is occurring, even if a passenger in the passenger compartment manipulates the door handle or the wire is pulled by other components, the locking protrusion 642 pushes only the release lever 200 and rotates it but cannot push the open lever 400. Therefore, the open lever 400 does not rotate, making it impossible to release the door. This process is illustrated in detail in FIG. 8.

On the other hand, after the collision is over, that is, after the inertial force is removed, the inertia lever 800 returns its original position so that the locking protrusion 642 moves upwards again to the position at which it can push the open lever 400, thus allowing the door to be released when the wire is pulled. To embody the returning of the inertia lever 800, a spring or the like may be provided. The spring may be provided on an auxiliary bracket 700 to which the operating lever 600 is connected. This structure will be explained later herein.

The inertia lever 800 operating in this manner makes it impossible to open the door while a collision is occurring, and allows the door to open after the collision is over, thus enabling the passenger to escape from the vehicle.

Meanwhile, the release lever 200 includes the extension part 260 that extends a predetermined length downwards. The first slot 262 is vertically formed in the extension part 260. The lower end of the open lever 400 along with the first slot 262 comes into contact with the locking protrusion 642. The lower end of the open lever 400 is shorter than the first slot 262 so that under normal conditions, the locking protrusion 642 of the operating lever 600 can push the open lever 400, but after the operating lever 600 has moved downwards, the locking protrusion 642 can push only the release lever 200 but cannot push the open lever 400.

FIG. 6 is a perspective view showing the door latch apparatus of FIG. 5 from a different angle. FIG. 7 is a perspective view showing a critical portion of the door latch apparatus of FIG. 6. These drawings clearly show the relationship among the above-mentioned components.

The release lever 200 and the open lever 400 are provided on the hinge pin 220 with the spring so that they can return to their original positions after having rotated, thus making it possible to repeat the operation of opening the door.

Furthermore, the pivot protrusion 682 is provided on an upper end 680 of the operating lever 600. A third slot 720 is formed in the auxiliary bracket 700 mounted to the base plate 100. The pivot protrusion 682 of the operating lever 600 is disposed in the third slot 720 so as to be rotatable and vertically movable. The auxiliary bracket 700 is illustrated in FIG. 6. In detail, the auxiliary bracket 700 is coupled to the base plate 100 with a spring. Thus, when the inertial force is removed after the operating lever 600 has been moved downwards by the reverse rotation of the inertia lever 800, the auxiliary bracket 700 returns to its original position, thus moving the operating lever 600 upwards. The pivot protrusion 682 of the operating lever 600 is disposed in the third slot 720 of the auxiliary bracket 700 and is comparatively long so that when the operating lever 600 moves upwards or downwards, the pivot protrusion 682 rotates the auxiliary bracket 700, and when the operating lever 600 rotates in the clockwise/counterclockwise direction, the pivot protrusion 682 can rotate within a predetermined angular range because there is an appropriate clearance between the pivot protrusion 682 and the third slot 720.

Further, in the operating lever 600, the pivot protrusion 682 is provided on the upper end 680, the second slot 662 is formed in the medial portion 660, and the locking protrusion 642 is provided on the lower end 640.

The medial portion of the inertia lever 800 is coupled to the base plate 100 by the rotating shaft 820, the insert protrusion 860 is provided on a first end of the inertia lever 800, and a balance weight 840 is provided on a second end thereof. In detail, the inertia lever 800 is configured such that the first and second ends thereof are bent from each other based on the medial portion thereof, the medial portion thereof is coupled to the base plate 100 by the rotating shaft 820, and the insert protrusion 860 and the balance weight 840 are respectively provided on the first and second ends thereof. Hence, the inertia lever 800 can be effectively rotated by inertia.

As described above, a door latch apparatus for a vehicle according to an exemplary embodiment of the present invention makes use of a weight structure such that in a side collision of the vehicle, even when the door handle is operated by a passenger or other objects in the compartment of the vehicle, the door cannot open while the collision is ongoing. On the other hand, after the collision is over, it again becomes possible for the door handle to be used by a passenger to open the door.

Therefore, while the collision is ongoing, the door is prevented from opening, and after the collision is over, the door is allowed to open. As a result, safety in the collision can be ensured.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A door latch apparatus for a vehicle, the door latch apparatus comprising:

an open lever rotatably coupled to a base plate by a first hinge pin to lock/release a door depending on rotation of the open lever;

a release lever rotatably coupled to the base plate by the first hinge pin along with the open lever and having a first slot extending in a predetermined length;

an interlocking lever rotatably coupled to the base plate by a hinge shaft and having a pushing protrusion provided on an end of the interlocking lever, the pushing protrusion coming into contact with and pushing a lower end of the release lever so that the release lever is rotated by rotation of the interlocking lever, the rotating release lever pushing a locking protrusion disposed in the first slot of the release lever, and the locking protrusion then pushing and rotating the open lever, thus releasing the door;

an operating lever provided on the base plate so as to be rotatable and vertically movable, the operating lever including:

a second slot formed in a medial portion of the operating lever; and the locking protrusion formed on a lower end of the operating lever and being engaged in the first slot; and an inertia lever rotatably coupled to the base plate by a rotating shaft and including an insert protrusion formed on an end of the inertia lever and being engaged to the second slot, wherein when the vehicle is involved in a side collision, the inertia lever is reversely rotated by a force of inertia so that the insert protrusion moves the operating lever downwards, thus displacing the operating lever from a position at which the locking protrusion of the operating lever pushes the open lever, and thus preventing releasing of the door.

2. The door latch apparatus as set forth in claim 1, wherein a wire of a door handle is connected to another end of the interlocking lever.

3. The door latch apparatus as set forth in claim 1, wherein the release lever includes an extension part extending downwards, the first slot is longitudinally formed in the extension part, the lower end of the open lever along with the first slot comes into contact with the locking protrusion, and the lower end of the open lever is shorter than the first slot.

4. The door latch apparatus as set forth in claim 1, wherein the release lever and the open lever are elastically pivotable about the first hinge pin so that the release lever and the open lever return to original positions thereof after having rotated.

5. The door latch apparatus as set forth in claim 1, wherein a pivot protrusion is provided on an end of the operating lever, and an auxiliary bracket is provided on the base plate, the auxiliary bracket having a third slot in which the pivot protrusion is engaged, wherein the pivot protrusion of the operating lever vertically moves and rotates along the third slot.

6. The door latch apparatus as set forth in claim 5, wherein the auxiliary bracket is elastically and rotatably coupled to the base plate so that when the inertial force is removed after the operating lever has been rotated by the reverse rotation of the inertia lever, the auxiliary bracket returns to an original position thereof, thus moving the operating lever upwards.

7. The door latch apparatus as set forth in claim 5, wherein the pivot protrusion is provided on an upper end of the operating lever, the second slot is formed in the medial portion of the operating lever, and the locking protrusion is provided on the lower end of the operating lever.

8. The door latch apparatus as set forth in claim 1, wherein a medial portion of the inertia lever is coupled to the base plate by the rotating shaft, the insert protrusion is provided on a first end of the inertia lever, and a balance weight is provided on a second end of the inertia lever.

9. The door latch apparatus as set forth in claim 1, wherein a first end and a second end of the inertia lever are bent from each other based on a medial portion of the inertia lever, wherein the medial portion of the inertia lever is coupled to the base plate by the rotating shaft, the insert protrusion is provided on the first end of the inertia lever, and a balance weight is provided on the second end of the inertia lever.

* * * * *